US006092241A

United States Patent [19]

Bellet

[11] Patent Number: 6,092,241

[45] Date of Patent: Jul. 25, 2000

[54] SOCK MATES

[76] Inventor: Jerome Bellet, 177 Summit Ave., Pompton Lakes, N.J. 07442

[21] Appl. No.: 09/287,498

[22] Filed: Apr. 6, 1999

[51] Int. Cl.[7] ..... A41B 11/00

[52] U.S. Cl. ..... 2/239; 24/DIG. 29

[58] Field of Search ..... 2/239, 60, 912, 2/917, 919, 160, 244; 24/113 MP, 113 R, 662, 390, 303, 29, 108, 682.1; 40/633

[56] References Cited

U.S. PATENT DOCUMENTS

| | | | |
|---|---|---|---|
| 2,663,877 | 12/1953 | Bohman | 2/239 |
| 3,041,743 | 7/1962 | Monsma | 36/1 |
| 3,699,617 | 10/1972 | Hofmeister | 24/341 |
| 4,058,853 | 11/1977 | Boxer et al. | 2/239 |
| 4,962,573 | 10/1990 | Breveglieri | 24/573.1 |
| 5,038,413 | 8/1991 | Ursino | 2/239 |
| 5,321,855 | 6/1994 | Ciuffo | 2/239 |
| 5,329,677 | 7/1994 | Kanzaka | 24/687 |
| 5,357,660 | 10/1994 | Smith | 24/662 |
| 5,450,658 | 9/1995 | Hicks | 24/303 |
| 5,579,541 | 12/1996 | Christy et al. | 2/239 |
| 5,740,558 | 4/1998 | Messman | 2/239 |
| 5,918,318 | 7/1999 | Jones | 2/239 |

*Primary Examiner*—John J. Calvert
*Assistant Examiner*—Alissa L. Hoey
*Attorney, Agent, or Firm*—Walter Katz

[57] ABSTRACT

This invention relates to socks, and, more particularly, to socks having a complementary mate, which enable a pair of socks to be fastened together when not being worn or during laundering and drying.

1 Claim, 2 Drawing Sheets

SOCK MATES

BACKGROUND OF THE INVENTION

1. Field of the Invention

This invention relates to socks, and, more particularly, to socks having a complementary mate, which enable a pair of socks to be fastened together when not being worn or during laundering and drying.

2. Description of the Prior Art

A well-known problem associated with everyday laundering is the disarray that can occur with paired items of clothing such as socks. Through the laundering process, these matched pairs can become separated or lost, thus leaving the launderer with the unwanted task of having to match up the pairs of socks afterwards. Various attempts have been made to simplify this problem by using mechanical devices to keep the paired items together during the laundering process.

Boxer, in U.S. Pat. No. 4,058,853, for example, described an article to hold a pair of socks together during laundering or the like, particularly, a flexible patch secured to each sock which adheres them to each other when pressed together. Such self-contained hook and loop VELCRO fasteners, however are relatively inelastic while the shank portions of socks stretch.

Klotz, in U.S. Pat. No. 3,688,348, used special bands wrapped around the shanks of sock pairs to keep them together during washing. Such bands have the disadvantage of lack of availability at the time of discarding socks.

Ursino, in U.S. Pat. No. 5,038,413, described a snap type fastener article for securing socks which included decorative covers that concealed the fasteners while the socks were being worn. The removable covers, however, were especially dangerous to children who might pull the covers off, and then choke while trying to swallow the covers. Furthermore, the fastening means was attached through the body of the socks requiring a plurality of circumferentially spaced axially extending ribs to engage an annular rim portion of the fastener. This configuration did not secure the snap fastener means securely through the sock; thereupon, it could disengage easily when the socks were being washed.

Other related devices are shown in Bohman, U.S. Pat. No. 2,663,877; Hofmeister, U.S. Pat. No. 3,699,617; Sneider, U.S. Pat. No. 3,774,267; Ciuffo, U.S. Pat. No. 5,321,855; Hicks, U.S. Pat. No. 5,450,658; Hurst, U.S. Pat. No. 5,530,998; Christy, U.S. Pat. No. 5,579,541 and Messman, U.S. Pat. No. 5,740,558.

Accordingly, it is an object of the present invention to provide a new and improved sock mate device which can pair socks together during laundering without damaging the socks, and wherein an efficient fastening means is provided which can be easily applied to each sock and secured thereto.

Another object herein is to provide a time and labor saving device for the homemaker.

A time and labor saving device for the homemaker.

These and other objects and features of the invention will be made apparent from the following description thereof.

BRIEF DESCRIPTION OF THE DRAWINGS

Referring now to FIG. 1 and 2, there is shown in schematic detail the sock mate article 1 and 2 of the invention for fastening a pair of socks 3 and 4 during laundering to prevent separation during the washing cycle, and during later drying and storage. The sock fastening article 1 and 1A includes intermediate members or flexible strips 5, 5' having a peg plate 6 at one end of the strips 5, 5' and a receptor plate 7 at the other end of strips 5, 5'. Peg plate 6 and 6A includes a plurality of pins shown as 8 and 8A and 9 and 9A thereon which are adapted to be inserted through the inside 10 and 10A of the upper portion of sock 3 and terminated on the outside portion 11 and 11A of the sock. The receptor plate 7 has recesses 12 and 12A and 13 and 13A adapted to receive pins 8 and 9 of peg plate 6. Upon bending flexible strips 5, 5' over the sock, peg plate 6 and receptor plate 7 are positioned on the inside and outside portions of sock 3, respectively, and adjacent each other. When pins 8 and 9 penetrate the sock they are locked into the recesses of the receptor plate. When so secured, the flexible strips 5, 5' overhanging the top of the sock may be cut. However, if desired, the entire sock fastening means 1 may remain in place over the sock, i.e. without severing flexible strip members 5, 5'.

Receptor plate 7 is provided with a snap fastener recess 14. As shown in FIG. 2, the receptor plate 7A of companion snap fastening device 2 includes which a snap fastener 15 which can snap into recess 14 of plate 7.

FIG. 3 shows both socks positioned adjacent each other before insertion of snap fastener 15 of receptor plate 7A into recess 14 of receptor plate 7.

FIG. 4 is an embodiment of the invention in which most of flexible members 5 and 5A have been removed from their respective fastener members 1 and 2.

FIG. 5 illustrates both socks mated together before laundering.

FIG. 6 is a top view of FIG. 1 showing plastic strips 5, 5'.

FIG. 7 is a cross-sectional view of the sock mate articles of the invention prior to snap fastening together, with the flexible strip members substantially removed.

Figure 1:
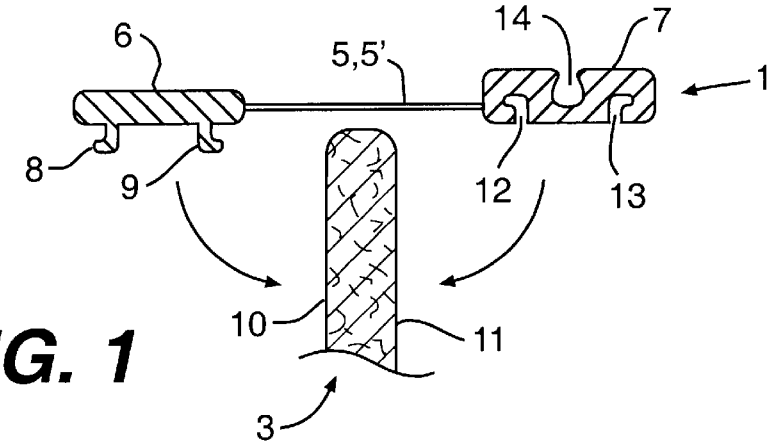
FIGS. 1 and 2 are a cross-sectional view of female and male snap fastening articles, respectively, of the invention, positioned for application onto socks.
Figure 2:
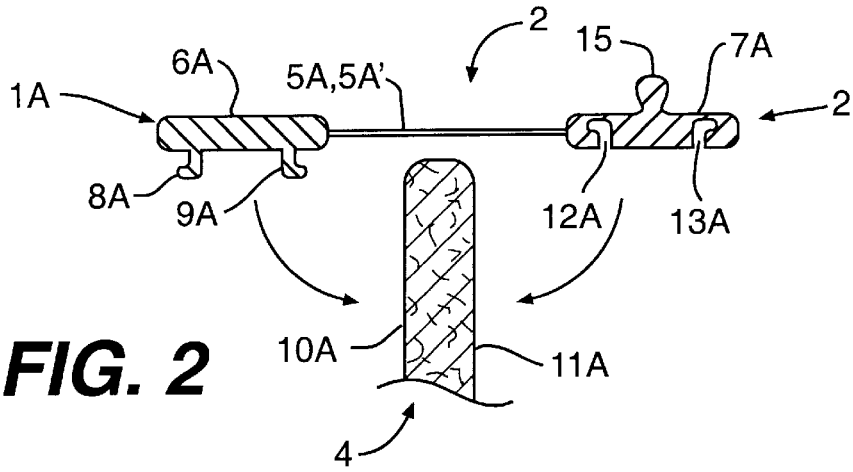
Figure 3:
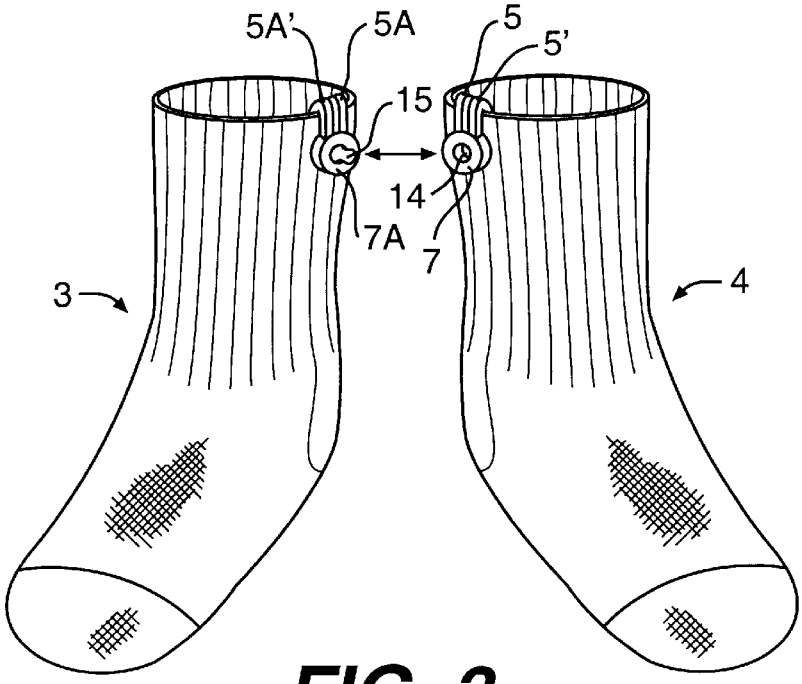
FIG. 3 is a schematic illustration of the snap fastening articles secured onto their respective socks and positioned opposite each other.
Figure 4:
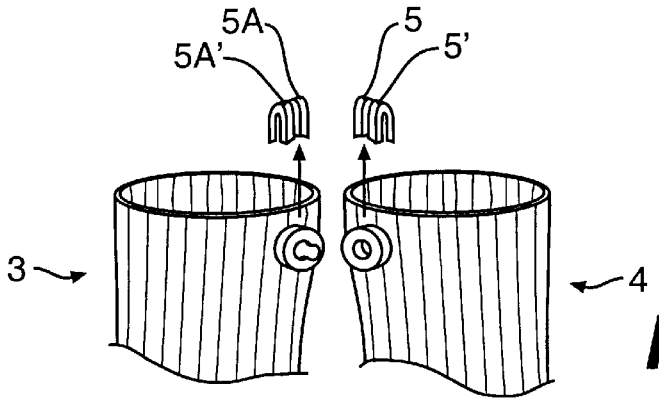
FIG. 4 shows the articles secured onto socks with two flexible strips removed.
Figure 5:
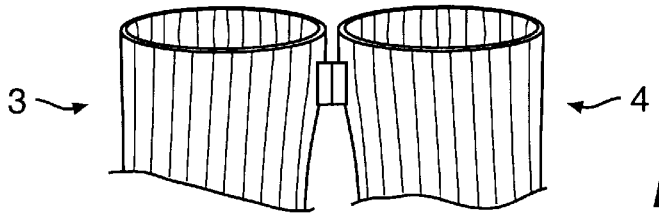
FIG. 5 shows both articles of FIG. 4 attached.
Figure 6:
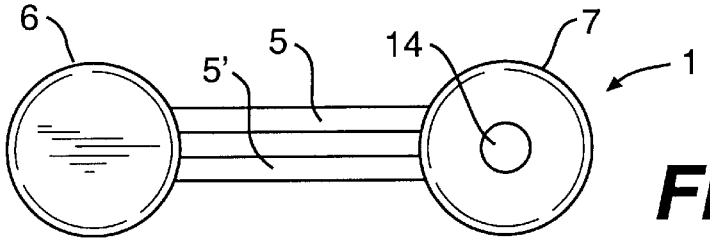
FIG. 6 is a top view of FIG. 1 showing flexible strips.
Figure 7:
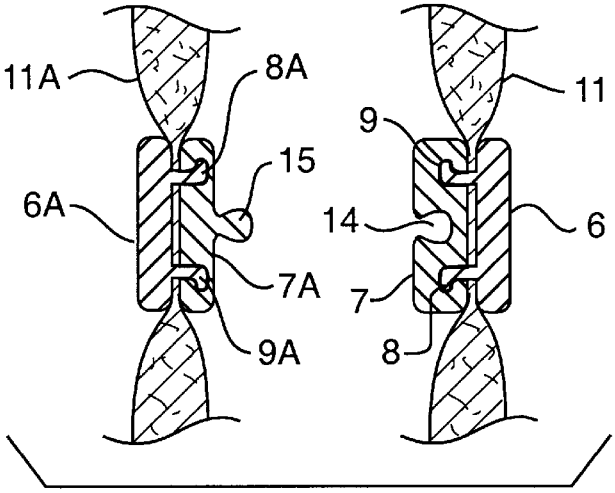
FIG. 7 is a cross-sectional view of the articles of the invention secured to socks.

While the invention has been described with particular reference to certain embodiments thereof, it will be understood that changes and modifications may be made which are within the skill of the art. Accordingly, it is intended to be bound only by the following claims, in which:

What is claimed is:

1. A sock mate article comprising a pair of socks each having inside, outside, side and top portions, a snap fastener article positioned permanently on each of said socks for securing them together thereby to prevent separation thereof during washing or drying, or during storage, each of said snap fastening articles including intermediate flexible strip members positioned below the top of the sock, each of said members having a peg plate at one end thereof, said peg plate including a plurality of pins extending through said inside of one of said socks, the other of said flexible strip members having a receptor plate at one end thereof, said receptor plate including a plurality of recesses positioned on said outside of said sock adjacent said pins to receive said extended pins to secure the snap fastener article against the side of said sock, and a male or female snap fastener element directed towards the other of said pair of socks, the other snap fastening article on the other of said pair of socks having a complementary snap fastening member to secure both socks when said articles are in place in each sock.

* * * * *